US008109501B2

(12) United States Patent
Suzuki

(10) Patent No.: US 8,109,501 B2
(45) Date of Patent: Feb. 7, 2012

(54) SHEET FEEDING DEVICE WITH GUIDE MEMBER

(75) Inventor: Tomoo Suzuki, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 65 days.

(21) Appl. No.: 12/409,750

(22) Filed: Mar. 24, 2009

(65) Prior Publication Data

US 2009/0243191 A1 Oct. 1, 2009

(30) Foreign Application Priority Data

Mar. 27, 2008 (JP) ..... 2008-083128

(51) Int. Cl.
*B65H 3/52* (2006.01)

(52) U.S. Cl. ..... 271/121

(58) Field of Classification Search ..... 271/121, 271/122, 124, 125, 161
See application file for complete search history.

(56) References Cited

U.S. PATENT DOCUMENTS 4,958,825 A * 9/1990 Onomoto et al. ..... 271/119
5,172,900 A * 12/1992 Uno et al. ..... 271/125
6,402,135 B1 * 6/2002 Werner ..... 271/35
6,788,440 B1 * 9/2004 Sashida ..... 358/498
2003/0160379 A1 * 8/2003 Shimamura et al. ..... 271/10.01
2004/0260650 A1 * 12/2004 Nagaya et al. ..... 705/43

FOREIGN PATENT DOCUMENTS

JP 63-160946 A 7/1988
JP 4-7538 U 1/1992
JP 5-43073 A 2/1993
JP 5-58496 A 3/1993
JP 2000-264470 A 9/2000
JP 2001-294336 A 10/2001
JP 2005-225586 A 8/2005
JP 2007-254091 A 10/2007

OTHER PUBLICATIONS

Notice of Reasons for Refusal for JP2008-083128 with English translation mailed Feb. 2, 2010.
European Search Report for Application No./Patent No. 09155366.9-1256/2105396 dated May 27, 2010.

* cited by examiner

*Primary Examiner* — Jeremy R Severson
(74) *Attorney, Agent, or Firm* — Cantor Colburn LLP

(57) ABSTRACT

As a guide member provided on a conveyance path through which a sheet is conveyed toward a separation device, a guide member having a sloping guide surface is used, and the aforesaid guide member is arranged so that an uppermost stream point of the sloping guide surface may be positioned at the upstream side of a separation point of the aforesaid separation device and a lowermost stream point of the aforesaid guide surface may be positioned at the downstream side of the aforesaid separation point.

10 Claims, 7 Drawing Sheets

SHEET FEEDING DEVICE WITH GUIDE MEMBER

This application is based on Japanese Patent Application No. 2008-083128 filed on Mar. 27, 2008 in Japanese Patent Office, the entire content of which is hereby incorporated by reference.

BACKGROUND OF THE INVENTION

The present invention relates to a sheet feeding device that separates a sheet from a plurality of stacked sheets one sheet by one sheet and conveys to an image forming section or to an image reading section, in an image forming apparatus or an image reading apparatus.

As the sheet feeding device of this kind, those each being composed of a pickup roller, a feed roller and a retarding roller as is disclosed in, for example, Unexamined Japanese Patent Application Publication No. 5-43073, are widely used.

In this sheet feeding device, a sheet located at the outermost position of stacked sheets is caused to receive conveyance force by a pickup roller to be fed out and is conveyed after being separated from others by a feed roller and a retarding roller.

In the Unexamined Japanese Patent Application Publication No. 5-43073, between the pickup roller and the feed roller, there are provided guide members wherein a distance between the guide members arranged to interpose a sheet conveyance path between them becomes narrower gradually toward the downstream side from the upstream side in the sheet conveyance direction.

The sheet feeding device described in the Unexamined Japanese Patent Application Publication No. 5-43073 has a problem that conveyance of a thick sheet is not smooth, and sheet feeding failure tends to be caused.

Problems generated in the case of a thick sheet will be described as follows, referring to FIGS. 1 (*a*) and 1 (*b*).

When sheet S is left under low humidity environment for a long time, moisture evaporates from the sheet, and an amount of evaporation on a peripheral portion of the sheet is more than that on the central portion, resulting in occurrence of a curvature whose form is close to that of a part of a spherical surface on a surface of sheet S. As a result, when a sheet S is placed on a sheet feeding table, a lift that is shown with K is formed on each of both end portions of the sheet S.

FIG. 1 (*b*) shows a phenomenon that takes place in the sheet feeding for curved sheet S shown in FIG. 1 (*a*).

As is shown in FIG. 1 (*b*), leading edges K on both lifted end portions of the sheet S hit an inclined guide surface of the guide member 110, when Y represents the direction of conveyance for a sheet in sheet feeding. In the case of a thick sheet, the sheet S that hits the guide surface does not bend along the guide surface because stiffness of the sheet S is high, and thus, a leading edge of the sheet S is blocked by the guide member 110, which stops conveyance of the sheet S.

In the case of a thin sheet whose stiffness is low, a stop of conveyance of this kind hardly takes place, but when stiffness is high as in the case of a thick sheet, a stop of conveyance that is called no-feed tends to take place.

An objective of the invention is to solve the aforesaid problem in a conventional sheet feeding device, and thereby to provide a sheet feeding device that can feed sheets stably even in the case of a thick sheet.

SUMMARY

The objective of the invention is attained by the following invention.

Item 1.

A sheet feeding device which includes a pickup device which feeds a sheet by rotating while the pickup device comes in contact with a sheet located at an outermost position of a loaded stack of sheets, and a separation device which separates the sheet fed by the pickup device from another sheet and conveys the sheet with the separation device having a conveying device for conveying the sheet in a conveyance direction and a removing device for providing conveyance resistance on a lower surface of the sheet with the sheet feeding device further including a guide member for guiding the sheet from a point upstream of the separation device to a point downstream of the separation device in the conveyance direction, wherein the guide member comprises a sloping guide surface which is a slope so as to form a conveyance gap which is wider on an upstream side and narrower on a downstream side in the conveyance direction and wherein the sloping guide surface is formed so that an uppermost stream point of the slope is positioned on an upstream side of a separation point which is formed by the conveying device and the removing device in the conveyance direction and a lowermost stream point of the slope is positioned on a downstream side of the separation point in the conveyance direction.

Item 2.

An image forming apparatus provided with the sheet feeding device of Item 1.

BRIEF DESCRIPTION OF THE DRAWINGS

Each of FIG. 1 (*a*) and FIG. 1 (*b*) is a diagram illustrating no-feed that is caused in sheet feeding for curved thick sheets.

Figure 6:
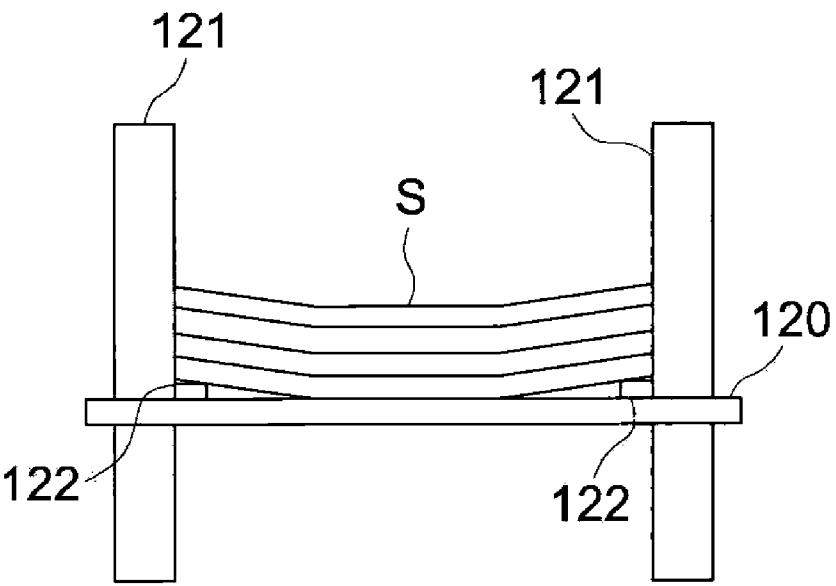
Figure 6:
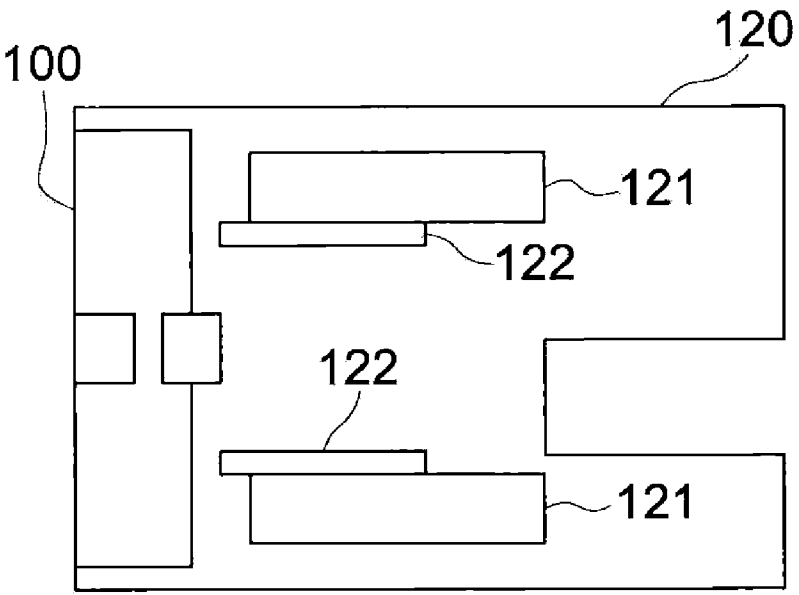

Each of FIG. 6 (*a*) and FIG. 6 (*b*) is a diagram showing a sheet feeding testing instrument.

Figure 7:
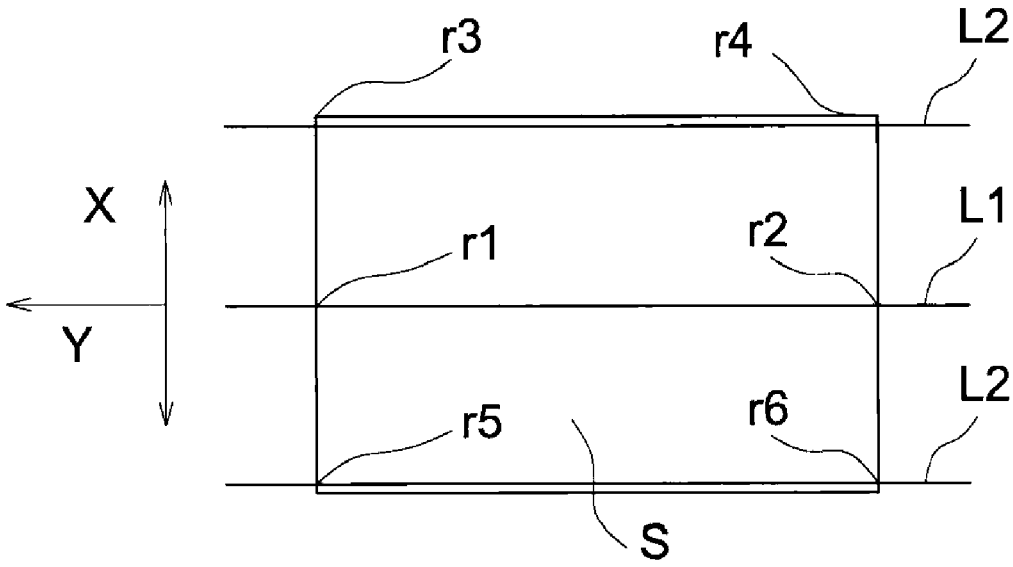
Figure 7:
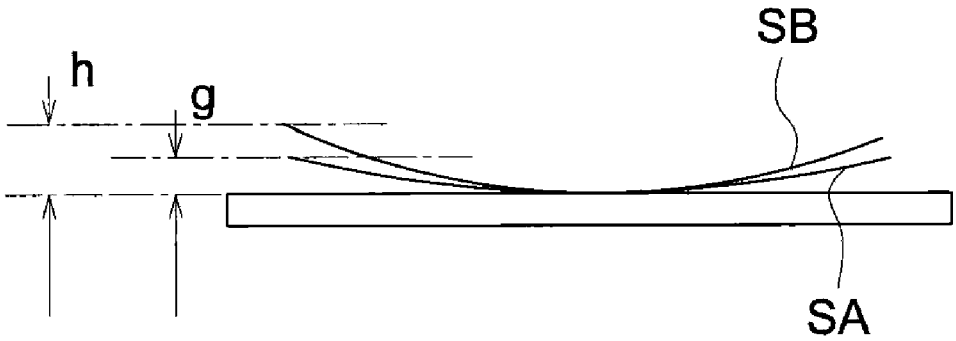

Each of FIG. 7 (*a*) and FIG. 7 (*b*) is a diagram showing an amount of curve.

DETAILED DESCRIPTION OF THE PREFERRED EMBODIMENT

[Image Forming Apparatus]

Figure 2:
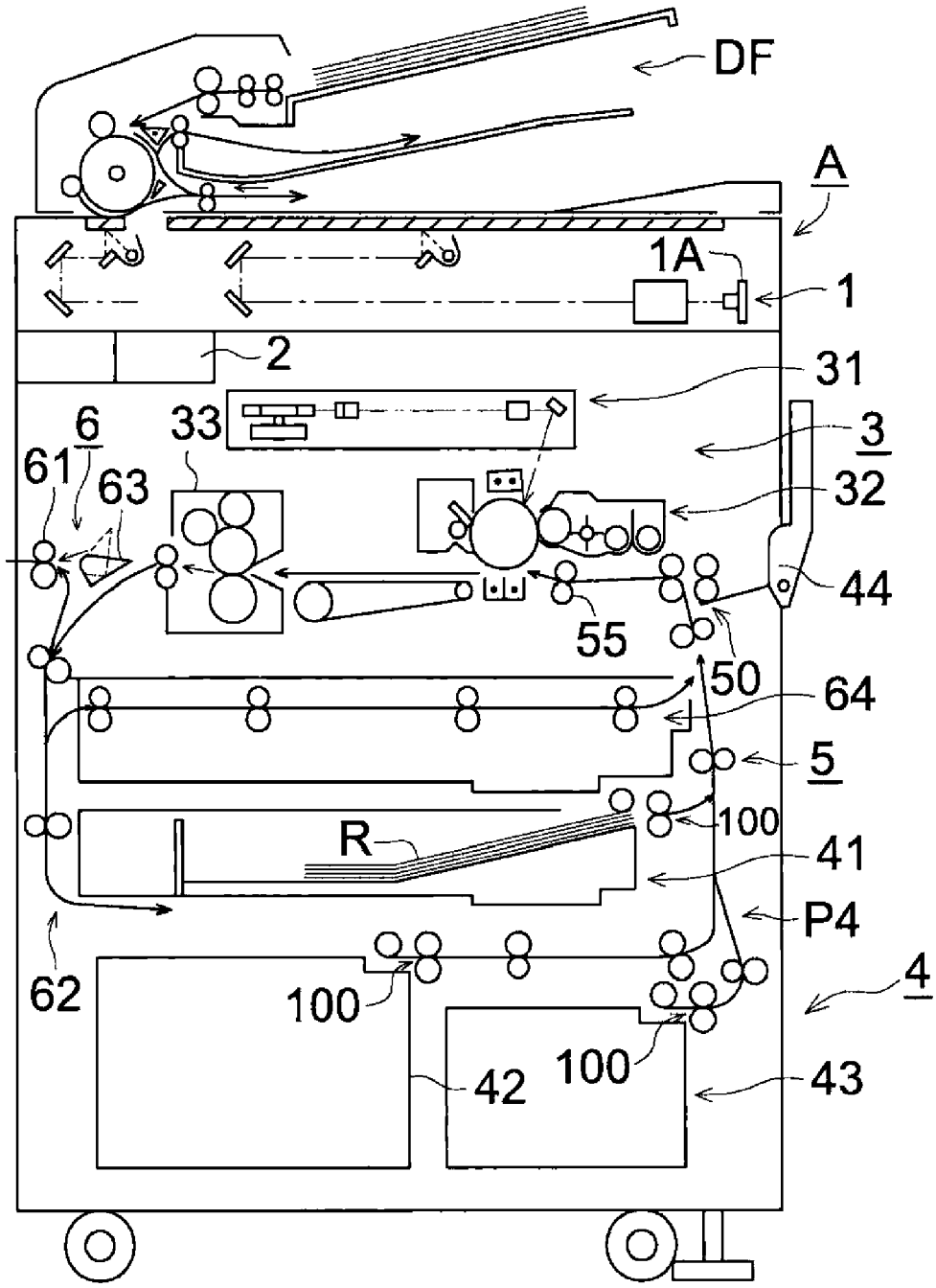
FIG. 2 is a diagram showing overall composition of an image forming apparatus in which a sheet feeding device relating to the embodiment of the invention is incorporated.

FIG. 2 is a diagram showing overall composition of an image forming apparatus in which a sheet feeding device relating to the embodiment of the invention is incorporated.

Image forming apparatus A is an apparatus for forming an image on sheet S through a well-known electrophotographic system, and the image forming apparatus A has thereon automatic document feeder DF. Further, the image forming apparatus A is equipped with image reading section 1, image processing section 2, image forming section 3, sheet storage section 4, sheet feeding section 100 and reversal and sheet-ejection device 6.

The automatic document feeder DF is an apparatus that separates documents placed on a document table (having no symbol) into a single sheet one by one, then, conveys it to an image reading position, and ejects it to sheet ejection tray (having no symbol). This automatic document feeder DF is also constructed to be capable of reversing a document upside down after conveying it to an image reading position, then, conveying again to the image reading position, to be ejected on a sheet ejection tray, and thus, it is possible to cause image reading section 1 described later to read only one side or both sides of the document. Incidentally, the automatic document feeder DF is made up so that a document may travel on an image reading position, and so that image reading section 1 which will be described later may read an image on a traveling document. However, it is also possible to constitute so that a document in transport is stopped temporarily, and the document that is at a standstill is read.

The image reading section 1 is a device that reads an image on a document to obtain image data and it is a device that reads an image on a document that is conveyed by the automatic document feeder DF. Namely, a document conveyed by the automatic document feeder DF is converted into image signals, on a photoelectric basis, by CCD (image sensor) 1A representing an image pickup device, through an optical system (having no symbol) that is at a standstill. In addition, as stated above, it is also possible to constitute to obtain image data from a document that is at a standstill, while moving an optical system. Further, though image forming apparatus A is equipped with image reading section 1, in the present embodiment, the image forming apparatus may also be one that obtains image data from an outer equipment through a network and thereby forms an image based on the image data.

Image processing section 2 conducts analog processing, A/D conversion, shading correction and image compression processing for analog signals converted by CCD image sensor 1A on a photoelectric basis. After image processing by the image processing section 2, signals are sent to image writing section 31 of image forming section 3 through a storing device (memory) AM that stores image data as occasion demands.

The image forming section 3 is one that forms an image on sheet S, and it forms an image through an electrophotographic system. The image forming section 3 has therein image writing section 31, image forming unit 32 and fixing section 33. The image writing section 31 is a device that gives exposure to a photoconductor drum (having no symbol) of image forming unit 32 which will be described later, based on the image data which have been read by image reading section 1 and have been image-processed by image processing section 2, and forms a latent image of an image. In other words, light outputted from semiconductor laser (having no symbol) based on the image data is applied on a photoconductor drum of image forming unit 32, and a latent image is formed. On the image forming unit 32, there are conducted charging, exposure and development for the photoconductor drum, and a toner image is formed on the photoconductor drum. The toner image is transferred onto sheet S conveyed toward the image forming unit 32. The photoconductor drum after transferring will be cleaned.

The fixing section 33 is a device that fixes a toner image transferred onto sheet S by image forming unit 32.

Sheet storing section 4 is a device to store sheets S on which an image will be formed by image forming section 3, and it has therein trays 41, 42 and 43 as well as manual bypass tray 44.

Sheet feeding device 100 is a device that feeds out sheet S one by one from a plurality of trays 41-43, and feeds a sheet to image forming section 3. This sheet feeding device 100 is provided to correspond to each of trays 41-43 to feed sheets S placed in trays 41-43.

Sheet S fed out of the sheet feeding device 100 is conveyed to registration roller 55 through conveyance section 5.

Sheet S fed through the manual feeding tray 44 is supplied to the registration roller 55 by sheet feeding device 50.

Reversal and sheet-ejection device 6 includes a sheet ejection device that ejects sheet S on which a toner image is fixed from image forming apparatus A, a reversing and ejecting device that reverses and ejects sheet S and a reversing device that reverses sheet S and conveys it again to image forming section 3.

The reversal and sheet-ejection device 6 has therein sheet ejection roller 61 for ejecting a sheet from image forming apparatus A, sheet reversing section 62 that reverses sheet S upside down, switching section 63 that switches a path to convey sheet S coming out of fixing section 33 to the sheet ejection roller 61 side or to the reversing section 62 side and conveyance section 64 that conveys sheet S reversed at the sheet reversing section 62 to the image forming section 3 again. Then, when ejecting the sheet S on which a toner image is fixed as it is, the sheet S is guided to the sheet ejection roller 61 side by the switching section 63 to be ejected out of image forming apparatus A.

When ejecting the sheet S on which a toner image is fixed after reversing the sheet upside down, the sheet S is guided to the sheet reversing section 62 side by the switching section 63 to be conveyed temporarily, then, the advancing direction of the sheet is reversed, and the sheet is conveyed to the sheet ejection roller 61 side, to be ejected out of image forming apparatus A.

Further, when forming an image on a surface of sheet S being opposite to the side of sheet S on which a toner image has been fixed, the sheet S is guided to the reversing section 62 side to be conveyed, then, the advancing direction for the sheet is reversed, and the sheet is conveyed by conveyance section 64 toward the upstream side of registration roller 55 in the conveyance direction, thus, an image is formed on the opposite side.

[Sheet Feeding Device]

Figure 3:
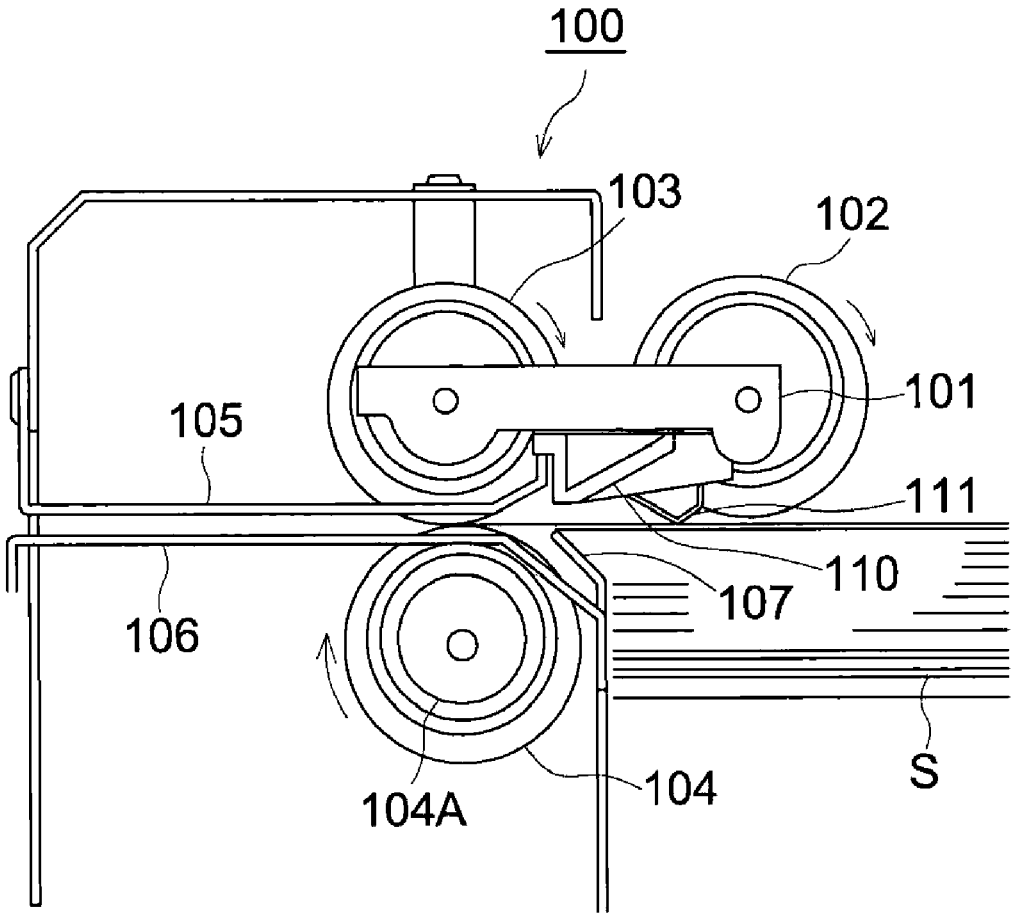
FIG. 3 is a front sectional view of sheet feeding device 100 relating to the embodiment of the invention.
Figure 4:
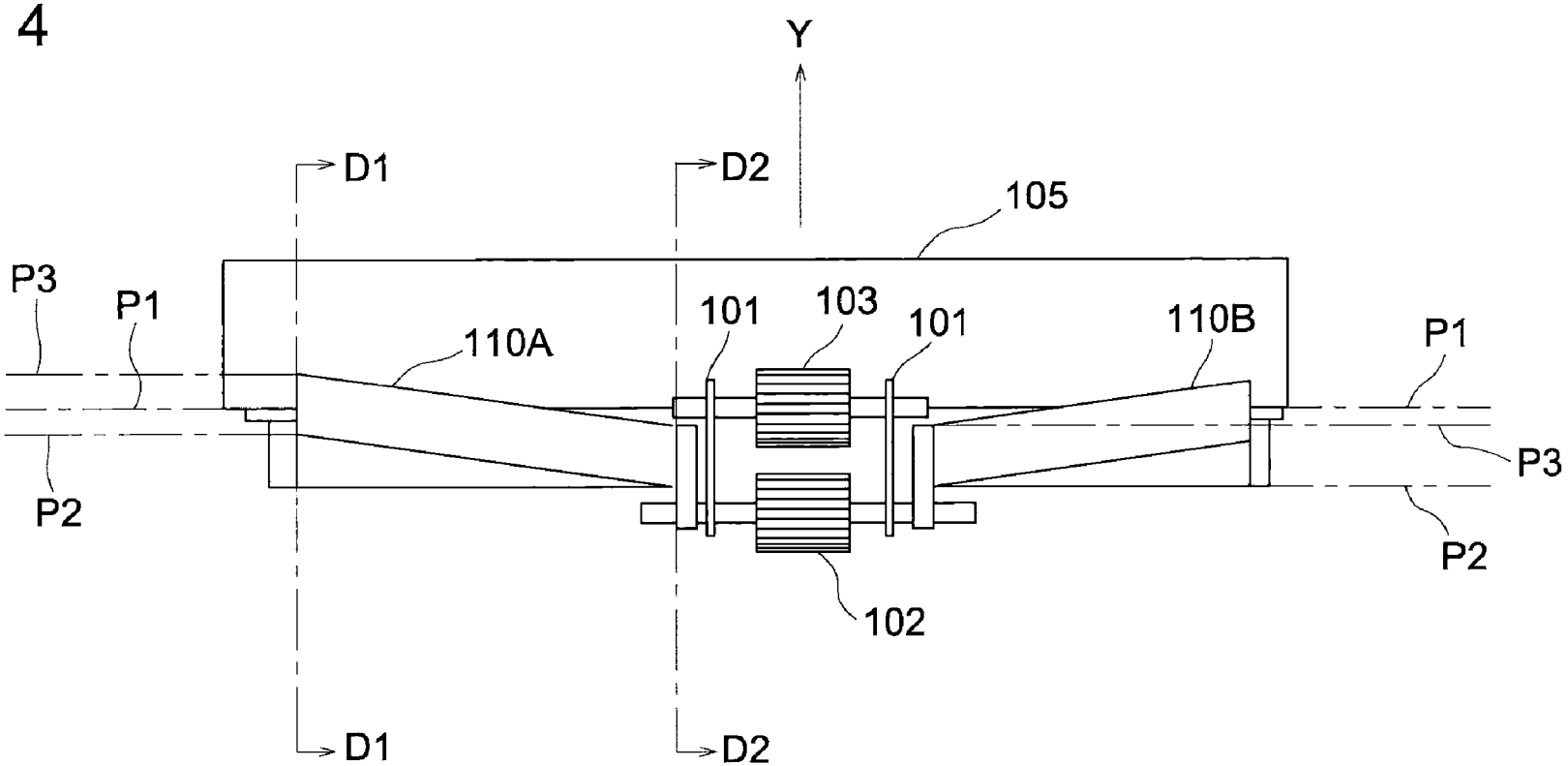
FIG. 4 is a top view of sheet feeding device 100 shown in FIG. 3.

The sheet feeding device relating to the embodiment of the present invention will be described as follows, referring to FIGS. 3-5 (*a*) and FIG. 5 (*b*). FIG. 3 is a front sectional view of sheet feeding device 100 relating to the embodiment of the invention, FIG. 4 is a top view of sheet-feeding device 100 shown in FIG. 3, and FIG. 5 (*a*) and FIG. 5 (*b*) are diagrams illustrating positional relationships between a guide member and a separation device, respectively in a central portion and an end portion in the width direction of a sheet (direction perpendicular to conveyance direction for the sheet).

The sheet-feeding device 100 has therein pickup roller 102 representing a pickup device, feed roller 103 representing a conveyance device that constitutes a separation device and retarding roller 104 representing a removing device that constitutes the aforesaid separation device.

Feed roller 103 and retarding roller 104 are supported respectively on fixed shafts to be rotated.

The pickup roller 102 is supported on swing lever 101 that is supported by a rotary shaft for the feed roller 103, and it is displaced vertically by swinging of the swing lever 101.

The pickup roller 102 is caused by its own weight to be in contact with pressure on the top surface of sheet S.

Each of the pickup roller 102 and the feed roller 103 is driven by the same driving source (not shown) to rotate respectively in the direction of an arrow, and stacked sheets S are conveyed by these pickup roller 102 and feed roller 103 toward the left side (Y direction), beginning with an uppermost sheet.

The retarding roller 104 is given a rotary power in the direction of an arrow by a driving source (not shown). This direction of the rotary power is opposite to the direction of a rotary power given to the feed roller 103 as is illustrated, at a point of contact with the feed roller 103.

The retarding roller 104 has a torque limiter 104A. Therefore, when the feed roller 103 rotates in the direction of the arrow, the retarding roller 104 is driven by the feed roller 103 to rotate under prescribed resistance.

Each of numerals 105 and 106 is a guide member that guides sheet S at the downstream side of a point of separation for the sheet, and the numeral 107 is a guide member that guides sheet S at the upstream side of a point of separation for the sheet. As is illustrated, each of guide members 105 and 106 has a guide surface wherein a width thereof is broader at the upstream side in conveyance direction Y for sheet S and a width thereof is narrower at the downstream side and has a parallel guide surface extending from the aforesaid guide surface.

Incidentally, the expression of aforesaid upstream and downstream sides is based on the conveyance direction for sheet S.

The numeral 111 represents a sensor that detects the uppermost surface of stacked sheets S. The uppermost surface of the stacked sheets S is controlled to be at a fixed height constantly, based on detection signals of the sensor 111, and this controlling method is widely known.

Next, guide member 110 will be describe as follows.

Figure 5:
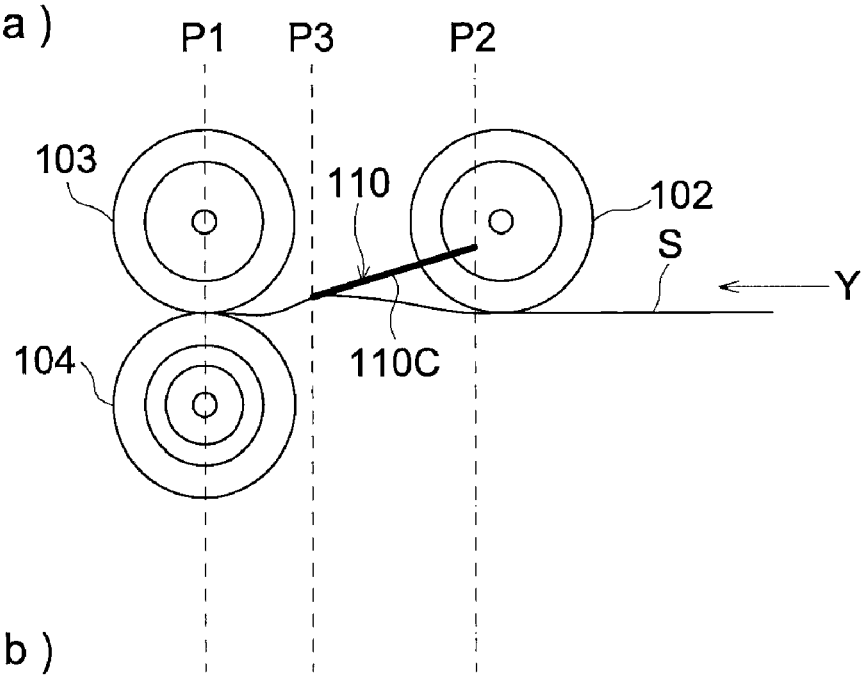
FIG. 5 (*a*) and FIG. 5 (*b*) are diagrams illustrating positional relationships between a guide member and a separation device, respectively in the central portion and an end portion in the width direction of a sheet.
Figure 5:
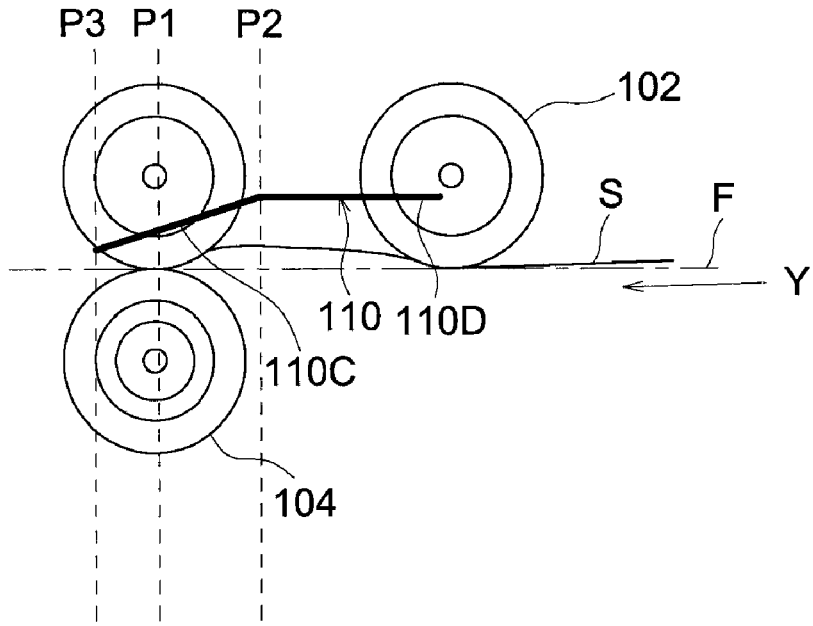

The guide member 110 has sloping guide surface 110C representing a slope whose upstream side in the conveyance direction Y for sheet S is positioned to be higher and the downstream side is positioned to be lower as shown in FIGS. 5 (*a*) and 5 (*b*).

Owing to the sloping guide surface 110C of the guide member 110, a leading edge of sheet S is not caught at an entrance and sheet S is guided to the separation point, namely, to a nipping portion between the feed roller 103 and the retarding roller 104.

As shown in FIG. 4, the guide member 110 is composed of guide member 110A and guide member 110B which are substantially symmetrical about a center line in width direction X.

As illustrated, each of the guide members 110A and 110B is extending obliquely toward the downstream side from the center portion in the width direction X to an end portion.

FIG. 5 (*a*) shows a sectional view along line D2-D2 at the center portion in the width direction in FIG. 4, while, FIG. 5 (*b*) is a sectional view along line D1-D1 at an end portion in the width direction in FIG. 4.

As shown in FIG. 5 (*a*) and FIG. 5 (*b*), the guide surface 110C of the guide member 110 is a guide surface on which each sectional portion from a central part up to an end portion has the same slope.

A position of the sloping guide surface 110C on the central portion is shifted from that of the sloping guide surface 110C on the end portion.

Namely, on the end portion shown in FIG. 5 (*b*), uppermost stream point P2 (a point to start tilting) on the guide surface 110C of the guide member 110 is positioned to be at the upstream side of separation point P1, and lowermost stream point (a point to finish tilting) P3 is positioned to be at the downstream side of separation point P1.

Meanwhile, the separation point P1 is the point of intersection of a line connecting the rotation center of feed roller 103 with the rotation center of retarding roller 104 with a line on which both rollers 103 and 104 are in contact with each other.

On the central part shown in FIG. 5 (*a*), uppermost stream point P2 and lowermost stream point P3 on the guide surface 110C of the guide member 110 are positioned to be at the upstream side of separation point P1.

Meanwhile, as shown in FIG. 5 (*b*), the guide member 110 has guide surface 110D that is in parallel with conveyance surface F for sheet S on the upstream side of sloping guide surface 110C.

The guide member 110A and the guide member 110B are in a shape which is substantially symmetrical about a center line in the width direction, and they have respectively the aforesaid sloping guide surface 110C and guide surface 110D that is in parallel with conveyance surface F.

On the central part in the width direction, sheet S is guided by guide member 110 to be conveyed to separation point P1 as shown in FIG. 5(*a*).

In other words, owing to the sloping guide surface 110C of the guide member 110, a leading edge of sheet S advances toward separation point P1.

On the upstream side of the separation point P1, the uppermost sheet S is not separated completely from sheet S that is immediately under the uppermost sheet S, whereby, plural sheets S are conveyed by conveyance power of pickup roller 102 toward separation point P1 with the uppermost sheet S leading the other sheet S.

In FIG. 5 (*b*), the guide member 110 having sloping guide surface 110C is in a shape wherein uppermost stream point P2 of guide surface 110C is at the upstream side of separation point P1 and lowermost stream point P3 of guide surface 110C is at the downstream side of separation point P1.

When sheet S is guided by the guide surface 110C of this kind, a leading edge of sheet S that is caused to touch the guide surface 110C of guide member 110 because of the curve of the sheet, touches feed roller 103 after touching the guide surface 110C before it arrives at separation point P1. The sheet S that has touched the feed roller is conveyed by feed roller 103.

Therefore, plural sheets S are prevented from being crammed into a narrow space on the upstream side of separation point P1.

Not only a thin sheet, as a matter of course, but also a thick sheet having high stiffness can be conveyed smoothly to separation point P1 by the sheet guide of this kind.

Guide surface 110D that is in parallel with conveyance surface F is formed at the upstream side of sloping guide surface 110C, on the end portion in the width direction shown in FIG. 5 (*b*).

A thick sheet can be guided more securely by this parallel guide surface 11D.

Thus, at separation point P1, uppermost sheet S only is conveyed by feed roller 103, and lower sheets S other than the uppermost sheet S are held by retarding roller 104.

In this way, sheet feeding in which a single sheet among sheets S is separated from the others and conveyed is carried out smoothly.

Further, as shown in FIG. 5 (*a*), there is formed guide member 110 so that uppermost stream point P2 and lowermost stream point P3 of guide surface 110C of guide member 110 may be positioned at the upstream side of separation point P1, on the central portion in the width direction.

Figure 1:
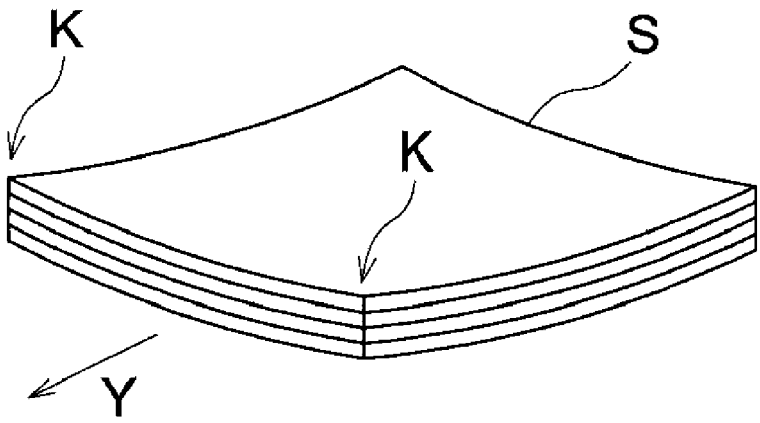
Figure 1:
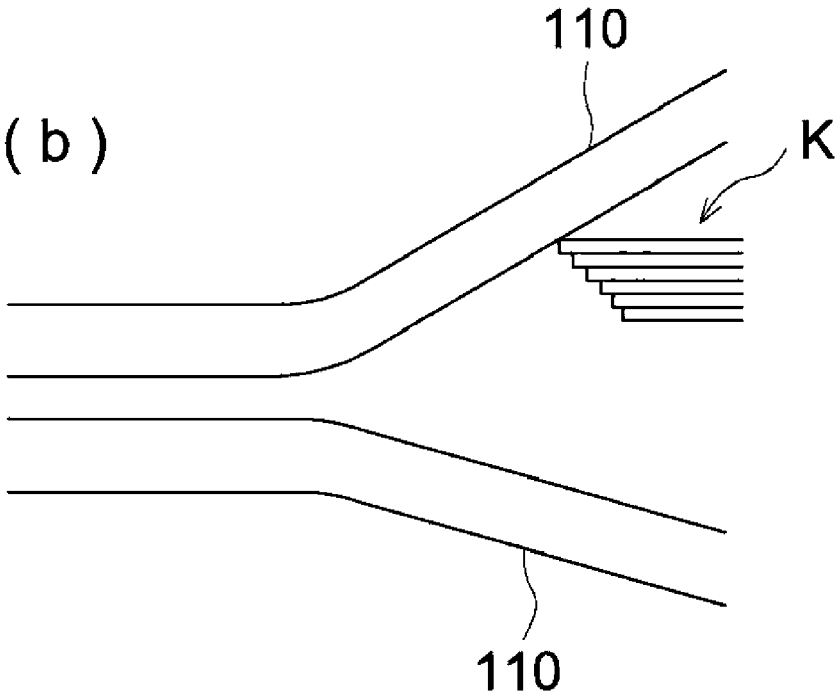

As shown in FIG. 1 (*a*), both end portions of curved sheet S are in the lifted form, but the central portion thereof does not exceed greatly the height regulated by pickup roller 102. Therefore, in the central portion, separation and conveyance of the sheet can be carried out smoothly even in the case of curved and thick sheet S.

By using guide member 110A and guide member 110B which have sloping guide surfaces and are arranged obliquely to be substantially symmetrical about a center line in width direction as shown in FIGS. 4, 5 (*a*) and 5 (*b*), smooth and stable sheet feeding can be carried out without occurrence of conveyance troubles such as no-feed, for various types of sheets S as stated above.

EXAMPLE

As shown in FIGS. 6 (*a*) and 6 (*b*), sheet feeding table 120 is arranged to face sheet feeding device 100, and side guide 121 that regulates the side of sheet S is positioned on each of both sides of the sheet feeding table 120.

Further, for the purpose of curving sheet S, spacer member 122 is caused to adhere to the sheet feeding table 120 to be fixed at each of both end positions close respectively to side guides 121.

As the spacer member 122, an object wherein plate-like members each having a thickness of 1 mm are superposed was used so that a height may be adjusted in millimeters.

Sheets were stacked on sheet feeding table 120 so that the total thickness may be about 10 mm.

As a sheet, a thick sheet having basis weight of 314 g/m$^2$ was used.

In the Example, a sheet feeding device shown in each of FIGS. 3 and 4 was used, and in the Comparative Example, there was used a sheet feeding device having a guide member whose cross section on a plane parallel to the conveyance direction is shown in FIG. 5 (*a*) and which is parallel to the width direction.

Sheet feeding tests for feeding a single sheet from stacked sheets S was conducted and an occasion where no-feed occurred during a period of sheet feeding for 5 sheets was ranked to be rejection "B" and an occasion where no-feed did not occur during a period of sheet feeding for 5 sheets was ranked to be acceptance "A."

Table 1 shows the results of the tests.

TABLE 1

| | Height of upper limit detection | Amount of lift on end portion (mm) | | | | | | | | |
|---|---|---|---|---|---|---|---|---|---|---|
| | | 1 | 2 | 3 | 4 | 5 | 6 | 7 | 8 | 9 |
| Comparative Example | Standard ± 0 mm | A | A | A | B | B | B | B | B | B |
| | Standard + 1 mm | A | A | A | A | B | B | B | B | B |
| Example | Standard ± 0 mm | A | A | A | A | A | A | A | A | B |
| | Standard + 1 mm | A | A | A | A | A | A | A | A | B |

Table 1 shows an occasion wherein the upper limit of sheet S established by sensor 111 is made to be standard±0 mm and an occasion wherein the upper limit of sheet S established by sensor 111 is made to be standard±1 mm, both with respect to "Height of upper limit detection".

TABLE 2

| | Amount of curve (h − g) (mm) | | | |
|---|---|---|---|---|
| | Sheet type 1 | Sheet type 2 | Sheet type 3 | Sheet type 4 |
| After 3 hours | 5.0 − 1.7 = 3.3 | 6.0 − 1.7 = 4.3 | 3.0 − 0.0 = 3.0 | 2.7 − 0.0 = 2.7 |
| After 4 days | 9.5 − 5.0 = 4.5 | 9.3 − 4.7 = 4.6 | 3.5 − 0.0 = 3.5 | 2.7 − 0.0 = 2.7 |
| After 9 days | 9.5 − 5.5 = 4.0 | 8.3 − 5.3 = 3.0 | 4.5 − 0.0 = 4.5 | 1.0 − 0.0 = 1.0 |

Table 2 shows results of the investigation of an amount of curve (degree of curvature) under the condition that four typical types of sheets available on the current market were left in low humidity environment.

As shown in FIG. 7 (*a*) and FIG. 7 (*b*), an amount of curve is difference amount of the lifts of sheet S (h−g) in the case where the sheet S is left on a flat plate.

SA in FIG. 7 (*b*) shows a section of sheet S along center line L1 in the width direction X, and SB shows a section of sheet S along edge line L2 in the width direction X.

Since sheet S left under the condition of low humidity environment is curved as shown in FIG. 1 (*a*) and FIG. 1 (*b*) and described earlier, the sheet S is lifted on both ends r1 and r2 in the conveyance direction even at the central portion in the width direction X.

The amount of lift g at the central portion is an amount of lift for the higher end among both ends r1 and r2.

With respect to end portions in the width direction, both ends in the conveyance direction r3 and r4 as well as r5 and r6 are lifted.

The amount of lift h of the end portion is an amount of lift that is the highest among those for r3, r4, r5 and r6.

An amount of curve is defined by the following expression.

$$\text{Amount of curve} = h - g$$

As is apparent from Table 2, an amount of curve of the sheet is within a range of 5 mm.

Table 1 shows that rejection started to occur on a spacer member having a thickness of 4 mm in Comparative Example, and that spacer members up to thickness of 8 mm were accepted in Example, and conveyance troubles including no-feed were prevented sufficiently for sheets in the range to be used.

When a guide member having a sloping guide surface is used, there is a possibility that buckling occurs on a sheet in sheet feeding for thin sheets and an edge portion is folded.

For the purpose of investigating sheet feeding capability for thin sheets for the sheet feeding device relating to the invention, following tests were conducted.

Sheet feeding tests were conducted on the sheet feeding device used in the aforesaid Example and Comparative Example by using a sheet having basis weight of 64 g/m$^2$ and by curving the sheet so that an amount of curve may become 20 mm.

As a result of sheet feeding conducted by stacking 100 sheets on the sheet feeding table, no sheet folding due to buckling or the like occurred, resulting in smooth sheet feeding, for both Example and Comparative Example.

Owing to these tests, it was possible to confirm that a sheet feeding device on which the measures for no-feed for thick sheets have been taken can feed sheets smoothly and stably even for thin sheets.

In the present invention, guide members are provided so that the uppermost stream point of the sloping guide surface may be positioned at the upstream side of a separation point formed by a conveyance device and a removing device constituting a separation device, and the lowermost stream point may be positioned at the downstream side of the aforesaid separation point, as stated above.

Owing to these guide members, a leading edge of the curved sheet can be guided to the separation point and conveyed by the aforesaid separation device even in the case of a curved thick sheet.

Therefore, even in the case of curved thick sheets, the sheet can be separated smoothly to one sheet to be conveyed.

What is claimed is:

1. A sheet feeding device, comprising:

a pickup device which feeds a sheet by rotating while the pickup device comes in contact with a sheet located at an outermost position of a loaded stack of sheets; and a separation device which separates the sheet fed by the pickup device from another sheet and conveys the sheet; the separation device comprising:

a conveying device for conveying the sheet in a conveyance direction; and a removing device for providing conveyance resistance on a lower surface of the sheet, the sheet feeding device further comprising, a guide member for guiding the sheet from a point upstream of the separation device to a point downstream of the separation device in the conveyance direction, wherein the guide member comprises a sloping guide surface which is a slope inclined with respect to a conveyance surface of the sheet in the conveyance direction of the sheet so as to form a conveyance gap which is wider on an upstream side and narrower on a downstream side in the conveyance direction, wherein the guide member extends toward both sides from a center in a width direction perpendicular to the conveyance direction, wherein, at an end portion of the sloping guide surface in the width direction, the sloping guide surface is formed so that an uppermost stream point of the slope is positioned on an upstream side of a separation point which is formed by the conveying device and the removing device in the conveyance direction and a lowermost stream point of the slope is positioned on a downstream side of the separation point in the conveyance direction, and wherein, at the center in the width direction, the sloping guide surface is formed so that both an uppermost stream point and a lowermost stream point of the slope are positioned on the upstream side of the separation point.

2. The sheet feeding device of claim 1, further comprising, an opposing guide member which is positioned on an opposite side of a sheet conveyance path from the guide member to face the guide member and has a guide surface which is a slope so as to form a conveyance gap which is wider on an upstream side and narrower on a downstream side in the conveyance direction on the upstream side of the separation point.

3. The sheet feeding device of claim 1, wherein the guide member has a parallel guide surface parallel to a the conveyance surface on an upstream side of the sloping guide surface in the conveyance direction.

4. The sheet feeding device of claim 1, wherein, at the end portion, the guide member has a parallel guide surface parallel to a the conveyance surface on an upstream side of the sloping guide surface in the conveyance direction.

5. An image forming apparatus provided with the sheet feeding device of claim 1.

6. The sheet feeding device of claim 1, wherein the slope of the sloping guide surface is formed so that an upstream side of the sloping guide surface is higher than a downstream side of the sloping guide surface with respect to the conveyance surface.

7. The sheet feeding device of claim 1, wherein the sloping guide surface extends toward the end portion from the center in the width direction.

8. The sheet feeding device of claim 7, wherein the sloping guide surface extends so that the end portion of the sloping guide surface is located in a downstream side of the center of the sloping guide surface.

9. The sheet feeding device of claim 1, wherein an end part of downstream side of the guide member in the conveyance direction is inclined from the width direction perpendicular to the conveyance direction.

10. The sheet feeding device of claim 9, wherein the end part of downstream side of the guide member in the conveyance direction is inclined so that the end part of the guide member at the end portion is located in a downstream side of the end part of the guide member at the center.

* * * * *